United States Patent [19]

Burnham et al.

[11] 4,223,884

[45] Sep. 23, 1980

[54] REVERSE BUCKLE SCUFF FEEDER

[75] Inventors: Bradshaw Burnham, Rochester; Gary B. Gustafson, Hilton, both of N.Y.

[73] Assignee: Eastman Kodak Company, Rochester, N.Y.

[21] Appl. No.: 8,653

[22] Filed: Feb. 1, 1979

[51] Int. Cl.[3] ..... B65H 3/06; B65H 3/42

[52] U.S. Cl. ..... 271/21; 271/120

[58] Field of Search ..... 271/16, 17, 19, 21–23, 271/119, 120

[56] References Cited

U.S. PATENT DOCUMENTS

| | | | |
|---|---|---|---|
| 825,264 | 7/1906 | Dick | 271/22 |
| 1,196,361 | 8/1916 | Howell et al. | 271/22 |
| 1,504,914 | 8/1924 | Stonemetz | 271/21 |
| 2,764,409 | 9/1956 | Bombard | 271/120 X |

FOREIGN PATENT DOCUMENTS

| | | | |
|---|---|---|---|
| 380443 | 6/1921 | Fed. Rep. of Germany | 271/22 |

*Primary Examiner*—Robert W. Saifer

*Attorney, Agent, or Firm*—Lawrence P. Kessler

[57] ABSTRACT

An improved apparatus for reverse buckle feeding of sheets seriatim from a sheet supply stack. The sheet feeding apparatus includes a feed roller, mounted for rotation about a longitudinal axis. The feed roller has a frictional sheet feeding peripheral surface in juxtaposition with one of the sheets of such stack. A second roller is mounted for rotation within the feed roller about a second axis which is parallel to the longitudinal axis of the feed roller. The second roller has a frictional sheet engaging peripheral surface, a portion of which extends through an opening in the peripheral surface of the feed roller radially beyond such surface. The second roller acts to urge the engaged sheet in the direction opposite to the feed direction. The feed roller and the second roller are simultaneously rotated in opposite directions about their respective axes, whereby the sheet engaging surface and the sheet feeding surface sequentially engage each sheet of the stack to first separate (buckle) and then feed the same from the stack. The apparatus may further include means to facilitate unimpeded movement of a fed sheet, relative to the sheet feeding surface, once the fed sheet is moving under the influence of a downstream transport. Such means also acts to prevent premature feeding of subsequent sheets.

11 Claims, 8 Drawing Figures

REVERSE BUCKLE SCUFF FEEDER

BACKGROUND OF THE INVENTION

1. Field of the Invention

This invention relates generaly to apparatus for feeding of sheets seriatim from a sheet supply stack, and more particularly to a sheet feeding apparatus having a unidirectionally rotating scuff feeder and a counter-rotating reverse buckle inducing roller.

2. Description of the Prior Art

In modern reproduction equipment, such as printers or electrophotographic copiers, it is common practice to feed sheets seriatim from a sheet supply stack to a reproduction station at which an image is applied to such sheets. A typical apparatus for seriatim feeding of sheets includes a rotating roller with a peripheral surface having a high coefficient of friction. The rotating roller is brought into contact with a sheet in the supply stack (either the top-most or bottom-most sheet) and frictionally drives the sheet from the stack into a transport for delivery to the reproduction station. Such friction feeding apparatus is referred to in the art as a scuff feeder.

While scuff feeders have found general acceptance for seriatim feeding of sheets, these feeders have a tendency to feed several sheets at one time. Further, they may prematurely feed subsequent sheets (after the fed sheet passes from control of the feeder), or may interfere with movement of the sheet when it is being fed by the downstream transport. Multiple sheet feeds, of course, are undesirable because they tend to jam in the downstream transports, causing machine shut-down, and waste non-imprinted sheets. In order to reduce the frequency of such multiple feeds, a technique called reverse buckle feeding was devised.

Reverse buckle feeding, as described for example in U.S. Pat. No. 3,944,215, issued Mar. 16, 1976 in the name of Beck, involves separating a sheet from the supply stack by first urging such sheet in a direction opposite to the direction of feed against a marginal support. Because the marginal edge of the sheet is restrained by the support, such urging causes the sheet to buckle transverse to the direction of travel thus separating that portion of the sheet from subsequent sheets in the supply stack. The buckled sheet is then fed in the feeding direction free of subsequent sheets which might otherwise have been tacked to the fed sheet. While reverse buckle feeding reduces multiple sheet feeds, it generally requires complex control of the scuff feeder in order to accomplish the multiple-direction feeding actions. Further, the problem of premature feeding of subsequent sheets or interference with downstream transport of a sheet by the scuff feeder is not addressed by reverse buckle scuff feeding.

SUMMARY OF THE INVENTION

This invention is directed to an improved apparatus for reverse buckle feeding of sheets seriatim from a sheet supply stack. The sheet feeding apparatus includes a feed roller, mounted for rotation about a longitudinal axis. The feed roller has a frictional sheet feeding peripheral surface mounted for juxtaposition with one of the sheets of such stack, and forms a scuff feed roller. A second roller is mounted for rotation within the feed roller about a second axis which is parallel to the longitudinal axis of the feed roller. The second roller has a frictional sheet engaging peripheral surface, a portion of which extends through an opening in the peripheral surface of the feed roller radially beyond such surface. The second roller forms a reverse buckle inducing feed roller which acts to urge the engaged sheet in the direction opposite to the feed direction. The feed roller and the secnd roller and simultaneously rotated in opposite directions about their respective axes, whereby the sheet engaging surface and the sheet feeding surface sequentially engage each sheet of the stack to first separate (buckle) and then feed the same from the stack. The apparatus may further include means to facilitate unimpeded movement of a fed sheet, relative to the sheet feeding surface, once the fed sheet is moving under the influence of a downstream transport. Such means also acts to prevent premature feeding of subsequent sheets.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
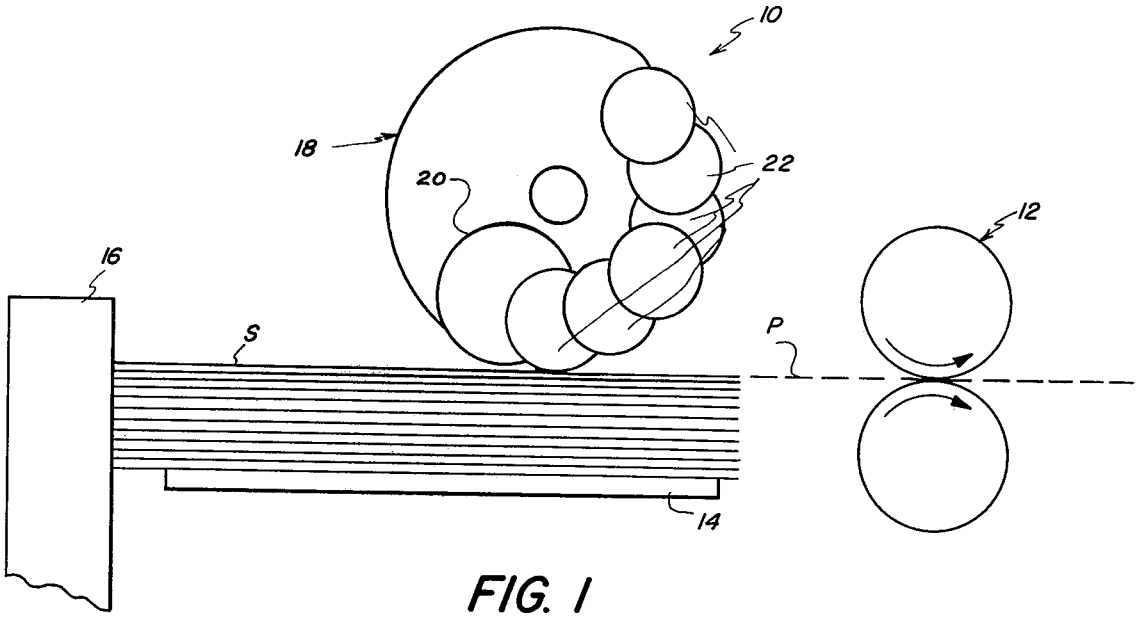
FIG. 1 is a schematic side elevational view of the sheet feeding apparatus according to this invention.
Figure 5:
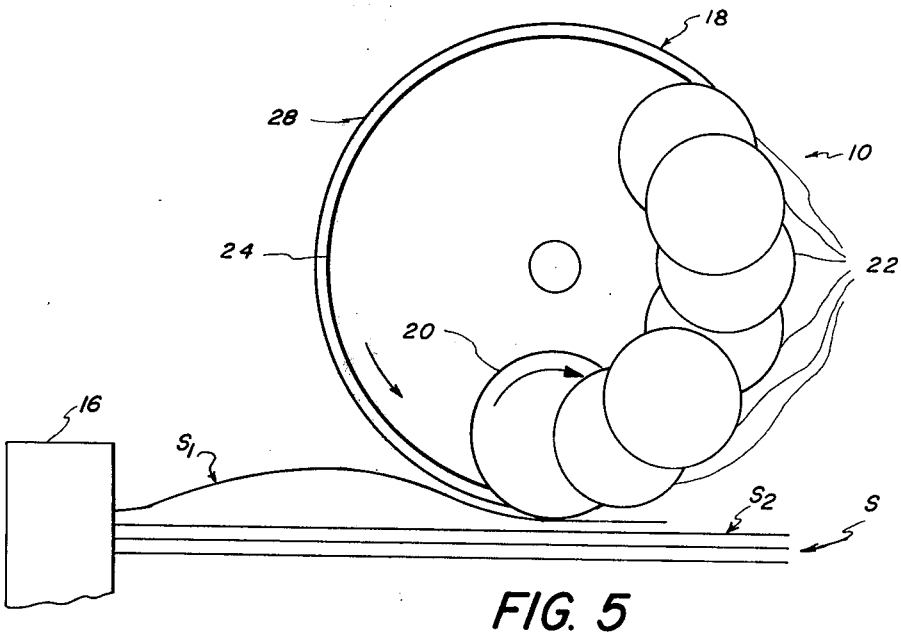
FIGS. 5 through 8 are schematic side elevational views of the sheet feeding apparatus, similar to FIG. 1, showing the apparatus at different times in its operative cycle.

Referring to the drawings, the improved sheet feeding apparatus 10 of this invention is shown schematically in FIG. 1 in juxtaposition with the top sheet in a supply stack S for feeding pre-cut sheets seriatim from the stack along a path P through a downstream transport, such as a pair of driven nip rollers 12. The stack S is supported on a platform 14 with the rear marginal edges of respective sheets in contact with a vertical backstop 16. The function of backstop 16, which may be fixed relative to the platform 14, is to prevent movement of the adjacent marginal edges of the sheets in the direction toward the backstop (opposite to the direction of feed). The apparatus 10 is maintained in contact with the top sheet in the stack S by elevating the platform 14 as the sheets are fed from the stack or by supporting the apparatus for following the height of the stack as it is depleted in a manner to be explained below. While the apparatus 10 and its operation are described as feeding sheets from the top of the stack S, it could be used to feed sheets from the bottom of the stack by a simple rearrangement of parts without departing from the instant invention.

The sheet feeding apparatus 10 comprises a scuff feed roller 18 carrying a counter-rotating reverse buckle inducing roller 20 and a series of idler wheels 22. As particularly shown in FIGS. 2 and 3, the roller 18 includes a cylindrical housing 24 having an internal chamber 26. Both roller 20 and a circumferential portion 28 of the external peripheral surface of the roller 18 are covered with a material having a relatively high coefficient of friction such as a synthetic rubber or elastomer having a hardness of 50 to 70 on the Shore Durometer A scale. One circumferential segment 28' (approximately 120°) of the portion 28 on the peripheral surface of roller 18 is of less diameter then that of segment 28" which forms the complimentary circumferential segment. The roller 18 has an opening 32 extending through the housing 24 and the material covering portion 28. The opening 32 is located adjacent to one edge 29 interconnecting segment 28' and segment 28".

Figure 2:
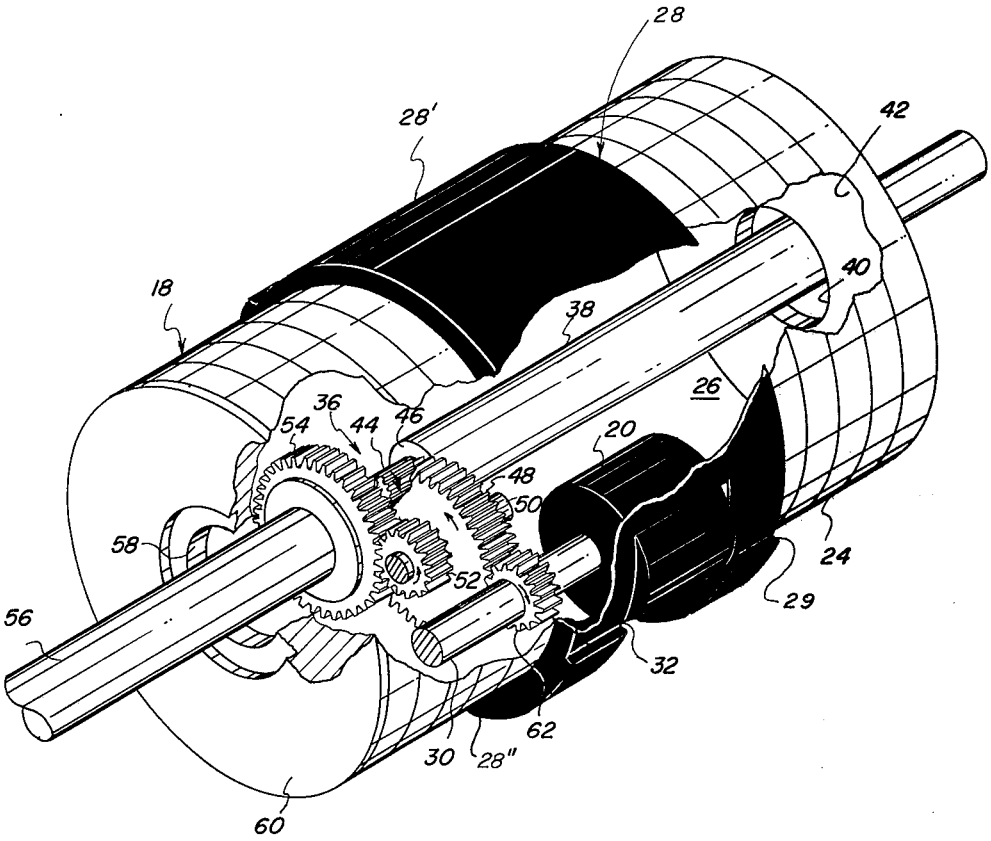
FIG. 2 is a view in perspective on an enlarged scale, of the scuff feed roller of the sheet feeding apparatus of FIG. 1, without the idler wheels, and with a portion broken away to expose the internal drive mechanism.
Figure 3:
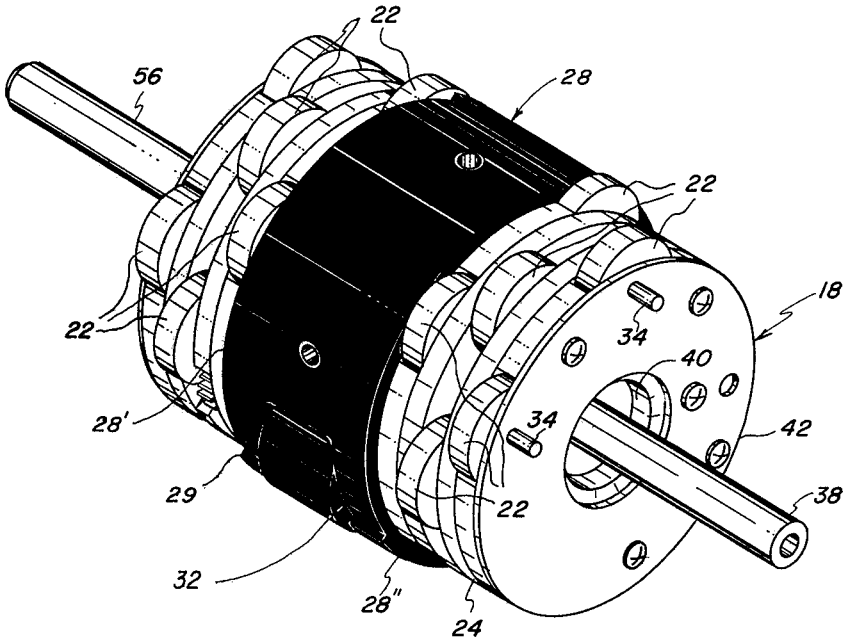
FIG. 3 is a view in perspective of the scuff feed roller of FIG. 2 taken from a different direction and includes the idler wheels.

A shaft 30 is supported within the chamber 26 of housing 24 adjacent to the opening 32, for rotation about an axis which is parallel to the longitudinal axis of the housing (FIG. 2). The roller 20 is fixed on the shaft 30 for rotation with the shaft. The diameter of the roller 20 is selected such that, when supported on the shaft 30, a portion of the peripheral surface of the roller extends radially outwardly from the roller 18, through the opening 32 beyond the peripheral surface of the material covering portion 28. The idler wheels 22 (FIG. 3) are mounted for free rotation on shafts 34 (two shown) carried by the housing 24. The axes of the shafts 34 are parallel to the longitudinal axis of the housing and positioned so that the idler wheels 22 are adjacent to the circumferential segment 28' of the portion 28. The peripheral surfaces of the idler wheels are formed of a material having a relatively low coefficient of friction, such as smooth nylon or Teflon. The shafts 34 are positioned in the housing 24 so that a portion of the respective peripheral surfaces of the idler wheels similarly extend radially outwardly from the roller 18 beyond the peripheral surface of the material covering portion 28.

An internal drive mechanism 36 rotates the roller 18 in a first direction (counterclockwise in FIG. 1) and simultaneously rotates the reverse buckle inducing roller 20 in an opposite direction (clockwise in FIG. 1). The drive mechanism 36 includes a unidirectionally rotatable drive shaft 38 extending into the chamber 26 through an opening 40 in an end wall 42 of the housing 24. The shaft 38 has a pinion gear 44 extending from the end 46 thereof. A first gear 48, fixed on a shaft 50, is in mesh with the pinion gear 44. The shaft 50, rotatable about its longitudinal axis, is carried by the housing 24. A second gear 52, integral with the first gear 48, is also fixed on the shaft 50. The gear 52 is in mesh with a stationary gear 54 fixed on a non-rotatable shaft 56 extending into the chamber 26 through an opening 58 in an end wall 60 of the housing 24. The first gear 48 is also in mesh with a third gear 62, fixed on the shaft 30. When the pinion gear 44 is rotated by the drive shaft 38 in the direction indicated by its arrow, the first gear 48 is rotated in the opposite direction as indicated by its respective arrow. Rotation of the gear 48 causes the second gear 52 to rotate in the same direction. At the same time, the third gear 62 is rotated in the direction indicated by its arrow due to its being in mesh with the gear 48. As the gear 52 rotates, it follows a planetary path about the periphery of the stationary gear 54 because of its mesh with the stationary gear. Since shaft 50 supporting the gear 52 is carried by the housing 24, the planetary motion of the gear 52 causes the housing to rotate in a like direction about its longitudinal axis. Concurrently, rotation of the gear 62 causes the shaft 30 to rotate the roller 20 in a like direction, which is opposite to the direction of rotation of the housing 24. Of course, pinion 44 could be eliminated by directly coupling shaft 38 to the housing 24, and rotating the shaft in the same direction as desired rotation of the housing. This rotation of the housing, carrying the shaft 50, causes the gear 52 to follow its planetary path about gear 54.

Figure 4:
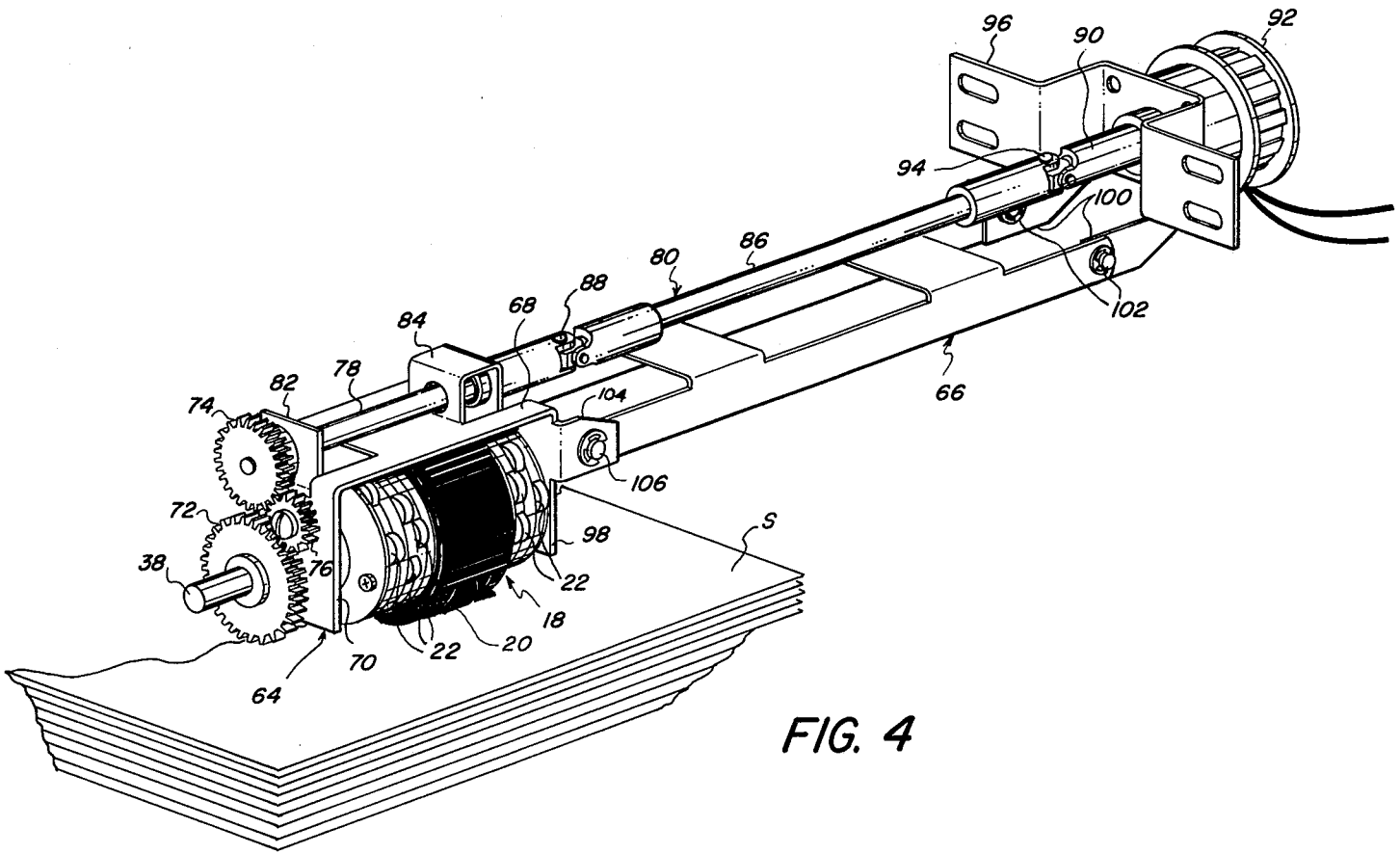
FIG. 4 is a view in perspective of the support frame for the sheet feeding apparatus.

As noted above, the roller 18 is maintained in contact with the top sheet in the stack S. The roller 18 is carried by a support frame 64 connected to a pivoting arm 66 (see FIG. 4). The support frame 64 includes a U-shaped bracket 68. One leg 98 of the bracket 68 carries a block (not shown) which supports the shaft 56 and prevents rotation of that shaft. The second leg 70 of the bracket 68 carries a bearing (not shown) which supports the shaft 38 for free rotation. A gear 72 fixed on the shaft 38 is operatively coupled to a drive gear 74 through an idler gear 76 rotatively supported on the leg 70. The drive gear 74, which is rotated by a drive shaft 80 of a motor 92, is fixed on a remote section 78 of the drive shaft 80. The section 78 is rotatively supported in upstanding arms 82 and 84 of the bracket 68. An intermediate section 86 of the drive shaft 80 is connected at one end to the section 78 through a universal coupling 88 and at the opposite end to the output section 90 through a universal coupling 94. The motor 92 is supported on a bracket 96 fixed to a frame (not shown). The bracket 96 has a pair of legs 100 which are connected to one end of the arm 66 by pins 102 which enable the arm 66 to pivot relative to the bracket 96. The opposite end of the arm 66 is connected to arms 104 (one shown) of the bracket 68 by pins 106 (one shown) which enable the arm 66 to pivot relative to the bracket 68. The pins 102 and 106 are positioned relative to the universal couplings 94 and 88 respectively to maintain a parallel relationship between the arm 66 and section 86 of the drive shaft 80.

With the described support arrangement, the roller 18 is urged by gravity into contact with the top sheet of the stack S. The arm 66 is free to change its angular orientation (by pivotal movement about pins 102) and, as such, enables the roller 18 to follow the height of the stack as the stack is depleted. The longitudinal axis of the roller 18 remains parallel to the plane of the sheets in the stack because of the pivotal movement of bracket 64 (relative to arm 66) about the pins 106. Since the intermediate section 86 of the drive shaft 80 is maintained parallel to the arm 66, the change in angular orientation of the arm compensates for the change in angle between the motor 92 and the point of contact of the roller 18 with the stack at any given height.

The operative cycle of the sheet feed apparatus 10 can best be described with reference to FIGS. 1 and 5 through 8. Initially, the roller 18 is supported with at least one idler roller 22 in contact with the top sheet $S_1$ in the stack S (FIG. 1). When feeding of a sheet is desired, the motor 92 is actuated so that the internal drive mechanism 36 rotates the housing 24 in a counterclockwise direction and the roller 20 in a clockwise direction. The housing 24 is rotated to the position represented in FIG. 5 which brings the roller 20 into engagement with the top sheet $S_1$. Since the friction material on portion 28 of the housing is maintained out of engagement with the top sheet $S_1$ by the radially extending portion of the peripheral surface of roller 20, the roller 20 is effective to frictionally urge the sheet $S_1$ toward the backstop 16. Since rear marginal edge of the sheet $S_1$ is prevented from movement by the backstop, a portion of the sheet $S_1$ buckles to separate that portion from the immediately subsequent sheet $S_2$. Alternatively, separation of the sheets, of the stack may be accomplished without actual buckling of the sheet but with an equivalent reverse feeding action. For example, a cut-out in the backstop adjacent to the rear marginal edge of the top sheet could allow the top sheet to move in the direction opposite to the feed direction under the urging of the roller 20 while the subsequent sheets are restrained by the backstop thus effecting separation.

Figure 6:
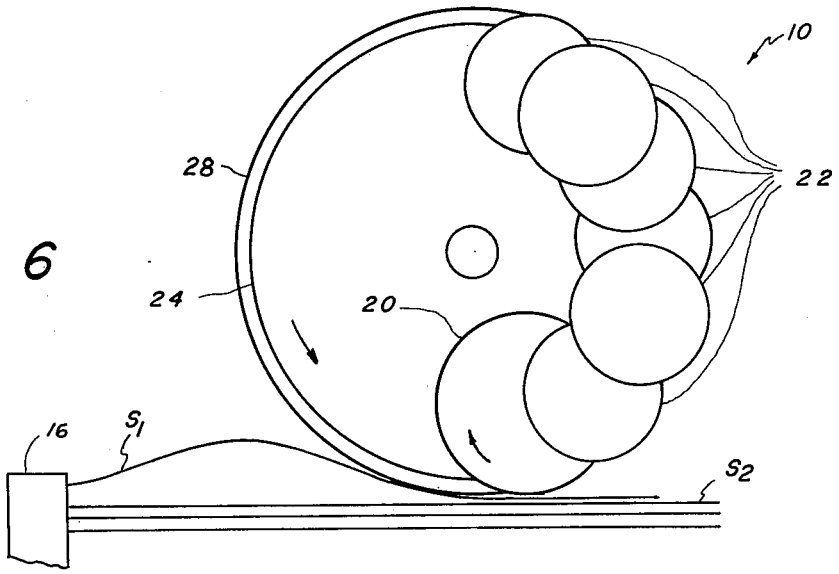
Figure 7:
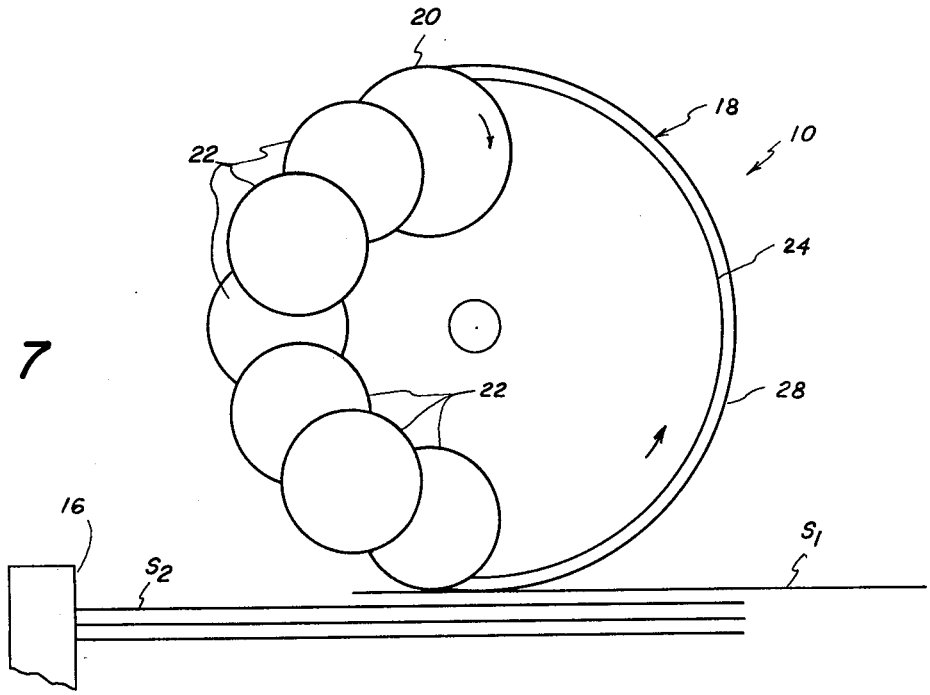

When the housing 24 is rotated to the position represented in FIG. 6, the roller 20 is carried to a position where its peripheral surface is disengaged from the sheet $S_1$ and the friction material on portion 28 of the housing 24 engages such sheet. From this time in the operative cycle until the time represented in FIG. 7, the rotation of the housing results in the friction material urging the sheet $S_1$ in the direction of travel along the path P into the downstream transport 12 (FIG. 1). Immediately after the time in the operative cycle represented in FIG. 7, the downstream transport 12 takes over transport of the sheet $S_1$ for feeding the sheet toward any desired remote location.

After the time when the downstream transport 12 (which may function at a transport velocity different from that of roller 18) takes over transport of the sheet $S_1$, the rotation of the housing 24 brings the idler rollers 22 sequentially into contact with the trailing portion of the sheet. The engagement of the idler rollers with the sheet, maintains the sheet out of engagement with the friction material covering portion 28. Thus the idler rollers effectively release the sheet from the influence of the friction material from immediately after the time in the operative cycle shown in FIG. 7 until after the time shown in FIG. 8. That is, the idler rollers rotate freely about their respective shafts 34 so that the sheet $S_1$ is free to move relative to the housing 24. In this manner, movement of the sheet $S_1$ is not impeded by the friction material. Further, when sheet $S_1$ is moved out from under the influence of the idler rollers 22 by the downstream transport 12 (see FIG. 8), the idler rollers engage the next subsequent sheet $S_2$ and enable the housing to freely move relative to such sheet. Thus, premature feeding of the sheet $S_2$ is prevented.

Figure 8:
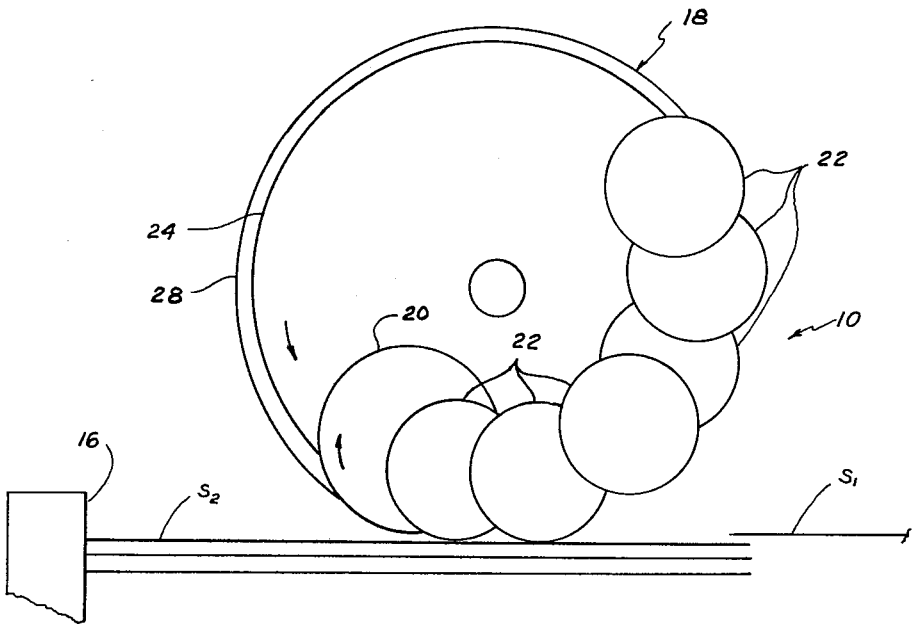

As the housing 24 is rotated past the position shown in FIG. 8, the sheet feed apparatus 10 arrives at the initial position shown in FIG. 1. Thereafter, the operative cycle may be repeated on the next subsequent sheet from the top of the stack S (in this instance, sheet $S_2$). Rotation of the housing 24 may be continuous so that the sheets are fed seriatim from the stack in a train, or may be interrupted by selective deactivation of the motor 92 so that the feeding of each sheet from the stack is controlled according to some desired timing cycle.

The invention has been described in detail with particular reference to a preferred embodiment thereof, but it will be understood that variations and modifications can be effected within the spirit and scope of the invention.

We claim:

1. Apparatus for feeding sheets from a stack comprising:

a feed roller mounted for rotation about a longitudinal axis, and having a frictional sheet feeding peripheral surface for juxtaposition with one of the sheets of such stack, said feed roller including an opening extending through said surface;

a second roller mounted for rotation within said feed roller about a second axis which is parallel to said longitudinal axis, said second roller having a frictional sheet engaging peripheral surface, a portion of said sheet engaging surface extending through said opening radially beyond said sheet feeding surface of said feed roller; and means for simultaneously rotating said feed roller and said second roller in opposite directions about their respective axes, whereby said sheet engaging surface and said sheet feeding surface sequentially engage each sheet of the stack to first separate and then feed the same from the stack.

2. The invention of claim 1 wherein said apparatus further includes second means operatively associated with said feed roller and extending radially beyond said sheet feeding surface of said feed roller, over less than a complete circumferential segment thereof, for engaging such sheets to maintain such segment of said feeding surface out of sheet feeding engagement with said sheets whereby said feed roller is free to move relative to such sheets when said second means is in engagement with such sheets.

3. The invention of claim 2 wherein said second means is positioned, in the direction of rotation, between said sheet feeding surface and said sheet engaging surface for engaging such sheet after it is fed from the stack and before a subsequent sheet is separated.

4. The invention of claim 2 wherein said feed roller further includes a plurality of openings in said sheet feeding surface, and said second means comprises a plurality of rollers having respective peripheral surfaces of a relatively low coefficient of friction and mounted for rotation within said feed roller about a plurality of axes respectively, which are parallel to said longitudinal axis, a portion of the respective peripheral surfaces of said rollers extending radially beyond said sheet feeding surface through said plurality of openings respectively.

5. The invention of claim 1 wherein said rotating means includes a unidirectionally rotatable drive shaft extending into said feed roller, means operatively coupling said drive shaft to said feed roller for rotating said feed roller in a first direction, and means operatively coupling said drive shaft to said second roller for rotating said second roller in a direction opposite to said first direction.

6. Apparatus for feeding sheets seriatim from a supply stack comprising:

first means mounted for juxtaposition with one of the sheets of said supply stack for frictionally feeding such sheet in a first, sheet feeding, direction;

second means operatively associated with said first means for frictionally urging such sheet in a direction opposite to said first direction;

third means operatively associated with said first means for selectively engaging such sheet and for maintaining such sheet out of frictional contact with said first means when in engagement with such sheet; and drive means for bringing, in order, said second, first, and third means into engagement with such sheet to first separate and then feed same from said supply stack, and subsequently to facilitate further unimpeded movement of such sheet and prevent a subsequent sheet from being prematurely fed by said first means.

7. The invention of claim 6 wherein:

said first means includes a hollow substantially cylindrical housing mounted for rotation about its longitudinal axis, a circumferential portion of the external peripheral surface of said housing having a relatively high coefficient of friction for engaging sheets, and an opening defined by said housing which extends through said circumferential portion; and said second means has an external peripheral surface with a relatively high coefficient of friction, and is mounted within said housing with a portion of its external peripheral surface extending through said opening radially outwardly of said housing to maintain a segment of said circumferential portion adjacent to said radially extending portion out of sheet feeding engagement with such sheets.

8. The invention of claim 7 wherein:

said second means includes a shaft mounted within said housing for rotation about an axis parallel to said longitudinal axis and a roller defining said external peripheral surface of said second means and supported on said shaft for rotation therewith; and said drive means includes a unidirectionally rotatable drive shaft extending into said housing, and means mounted within said housing for operatively coupling said drive shaft, said housing and said roller to simultaneously convert rotation of said drive shaft to rotation of said housing about said longitudinal axis in a first direction and to rotation of said roller about said parallel axis in an opposite direction.

9. The invention of claim 6 wherein:

said first means includes a hollow substantially cylindrical housing mounted for rotation about its longitudinal axis, a circumferential portion of the external peripheral surface of said housing having a relatively high coefficient of friction and a plurality of openings defined by said housing which extend through said circumferential portion; and said third means includes a plurality of idler rollers mounted within said housing for free rotation about their respective axes, said axes being parallel to said longitudinal axis, said idler rollers having external peripheral surfaces, portions of which extend radially outwardly of the external peripheral surface of said housing through said plurality of openings respectively to maintain a segment of said circumferential portion adjacent to said radially extending portions out of sheet feeding engagement with such sheets.

10. Apparatus for frictionally feeding sheets seriatim from a supply stack comprising:

a hollow substantially cylindrical housing having an external peripheral surface including a first opening and a plurality of second openings, at least a circumferential portion of said surface having a relatively high coefficient of friction for feeding sheets, said housing being mounted for rotation about a longitudinal axis with said sheet feeding portion in juxtaposition with a sheet of such stack.

a plurality of idler rollers mounted within said housing for free rotation about their respective axes which are parallel to said longitudinal axis of said housing, said plurality of idler rollers having external peripheral surfaces of relatively low coefficient of friction, portions of which extend radially outwardly beyond said sheet feeding portion of said housing through said plurality of second openings respectively for maintaining a segment of said sheet feeding portion adjacent to said radially extending portions out of engagement with such sheets;

a reverse buckle inducing roller mounted within said housing for rotation about an axis parallel to said longitudinal axis of said housing, said reverse buckle inducing roller having an external peripheral surface of relatively high coefficient of friction, a portion of such external peripheral surface extending radially outwardly beyond said sheet feeding portion of said housing through said first opening for maintaining a segment of said sheet feeding portion adjacent to said radially extending portion of said reverse buckle inducing roller out of engagement with such sheets; and means for rotating said housing about said longitudinal axis in a first direction and for simultaneously rotating said reverse buckle inducing roller about said parallel axis in an direction opposite to that of said housing to bring said reverse buckle inducing roller into contact with a sheet in said stack to urge such sheet in one direction, and subsequently to bring said sheet feeding portion of said housing into engagement with such sheet to feed such sheet in an opposite direction, and said idler rollers into contact with such sheet to enable said housing to have relative movement with respect to such sheet to facilitate further unimpeded movement of such sheet and prevent a subsequent sheet in said sheet supply stack from being prematurely fed.

11. The invention of claim 10 wherein said rotating means includes a unidirectionally rotatable drive shaft extending into said housing, and means mounted within said housing, in operative engagement with said drive shaft, for simultaneously converting rotation of said drive shaft to rotation of said housing in said first direction and rotation said reverse buckle inducing roller in said opposite direction.

* * * * *